US006145883A

United States Patent [19]

Jeter

[11] Patent Number: 6,145,883

[45] **Date of Patent: *Nov. 14, 2000**

[54] FILING SYSTEM

[75] Inventor: Jack W. Jeter, Akron, Ohio

[73] Assignee: Jeter Systems Corporation, Akron, Ohio

[ * ] Notice: Under 35 U.S.C. 154(b), the term of this patent shall be extended for 1074 days.

[21] Appl. No.: 08/555,795

[22] Filed: Nov. 9, 1995

Related U.S. Application Data

[63] Continuation of application No. 08/378,927, Jan. 25, 1995, abandoned, and a continuation of application No. 07/823,978, Jan. 22, 1992, abandoned.

[51] Int. Cl.[7] ..... B42F 21/00

[52] U.S. Cl. ..... 283/37; 40/359; 40/360; 40/641; 283/81; 283/114

[58] Field of Search ..... 283/37, 81, 114; 40/359, 360, 641

[56] References Cited

U.S. PATENT DOCUMENTS

| | | | |
|---|---|---|---|
| 4,050,719 | 9/1977 | Cunningham | 40/641 X |
| 4,329,191 | 5/1982 | Barber | 283/81 X |
| 4,523,776 | 6/1985 | Barber | 283/81 X |
| 4,544,182 | 10/1985 | Spring | 283/81 |
| 4,715,621 | 12/1987 | Colavito et al. | 40/359 X |
| 4,856,820 | 8/1989 | Kasprzak et al. | 283/81 |
| 4,889,982 | 12/1989 | Young et al. | 283/81 X |
| 5,083,816 | 1/1992 | Folgo et al. | 283/81 |

*Primary Examiner*—Andrea L. Pitts
*Assistant Examiner*—Monica Smith Carter
*Attorney, Agent, or Firm*—Renner, Kenner, Grieve, Bobak, Taylor & Weber

[57] ABSTRACT

A filing system based on an alpha numeric system in which the numeric portion is based upon birth dates and the alphabetic portion on the names of the individuals within the filing system. A label has color coded areas thereon corresponding to the birth date of an individual, and a color coded label designating the initial of the last name of the individual. A second label bears the individual name. The labels are placed upon a file folder which is then placed into a filing system broken into main sets and subsets. The main sets are arranged chronologically according to the date, while the subsets within each set are arranged alphabetically as a function of the individual's surname.

4 Claims, 1 Drawing Sheet

FILING SYSTEM

This is a continuation of application Ser. Nos. 08/378,927 filed Jan. 25, 1995 and 07/823,978, filed Jan. 22, 1992, now both abandoned.

TECHNICAL FIELD

The invention herein resides in the art of filing systems and devices. More particularly, the invention relates to a label and labeling system for file folders and the like. Specifically, the invention relates to a filing system and device in which files of individuals are identified and stored according to and as a function of the individual's birth date.

BACKGROUND ART

Numerous types of filing systems and devices are known. Presently, it is known to employ color coded systems to prevent and/or readily identify any misfiling of folders. Such a system has been extensively marketed by Jeter Systems Corporation, the assignee of the instant application. Such systems and devices are known to substantially prevent, reduce, or at least assist in the identifying of misfiling. However, there is a very important need for filing system and devices which allow for rapid classifying or categorizing of individuals within a filing system without the risk of duplication which results when several individuals have the same identifying characteristics. In most filing systems, the files associated with particular individuals are typically listed or categorized and filed alphabetically. Such a system allows for twenty-seven basic sets within the filing system, one for each of the twenty-six letters of the alphabet, and a twenty-seventh one for the prefix "Mc." However, in extremely large filing systems such as those encountered in the health care industry, there is a likelihood of duplicate names, including both first and last names, particularly when the surname is Jones, Smith, Wilson, or the like.

Health providers often have extremely large filing systems as a result of a patient base which may exceed fifty thousand or more. In such a filing system, similar or identical names are often encountered. Such gives rise to the risk of mixing files and data between various patients, a very risky situation, particularly in the health care industry. To break up large groups of individuals for receipt by filing systems, approaches have been taken to identify individuals with a numeric system, rather than an alphabetic one. Most typically, filing systems rely upon the social security number of the individual as a means of identification, since each individual's social security number is unique. However, it has been found that many individuals either do not have a social security number, such as children or the like, or they do not have a ready recollection of their social security number.

In order to provide a filing system which breaks up the large volumes of similar names which occur in total alphabetic systems, it is most attractive to provide some type of a numeric system, based upon numbers common to all individuals and which are readily remembered by such individuals. Further, by coupling a numeric base with an alphabetic subbase, further break-ups of the filing system base are achievable, further safeguarding against errors and misfilings. The combination of a numeric system with alphabetic subsets would be capable of accommodating extensive numbers of individuals and, if the alphabetic and numeric systems are substantially unique to each of the individuals within the system, the likelihood of misfilings and errors can be greatly reduced. Prior to the invention disclosed herein, a need for such a system existed within the art.

DISCLOSURE OF INVENTION

In light of the foregoing, it is a first aspect of the invention to provide a filing system based initially upon birth dates of individuals accommodated by the filing system.

Another aspect of the invention is the provision of a filing system which is based not only upon birth dates of the individuals therein, but is alphabetically subdivided for each birth date.

Still a further aspect of the invention is the provision of a filing system which provides for a label to be placed on each of the files, within the system, such labels being adapted to receive indicia of the associated individual indicative of his birth date and his name.

Yet an additional aspect of the invention is the provision of a filing system which substantially precludes the likelihood of duplication of file indicia.

The foregoing and other aspects of the invention which will become apparent as the detailed description proceeds are achieved by a file label system for identifying an individual, comprising: an elongated sheet; a first indicia on said sheet indicating a month of the year; a second indicia on said sheet indicating a day of said month; and a third indicia on said sheet indicating the initial letter of the last name of said individual.

Yet a further aspect of the invention which will become apparent herein are attained by a method for filing files associated with individuals, comprising: (a) affixing to each file a first indicia of the associated individual's birthday; (b) affixing to each file a second indicia of the associated individual's last name; and (c) placing said files in an array of files in a main set corresponding to said first indicia and in a subset corresponding to said second indicia.

DESCRIPTION OF DRAWING

For a complete understanding of the objects, techniques, and structure of the invention, reference should be made to the following detailed description and accompanying drawing wherein.

BEST MODE FOR CARRYING OUT THE INVENTION

Figure 1:
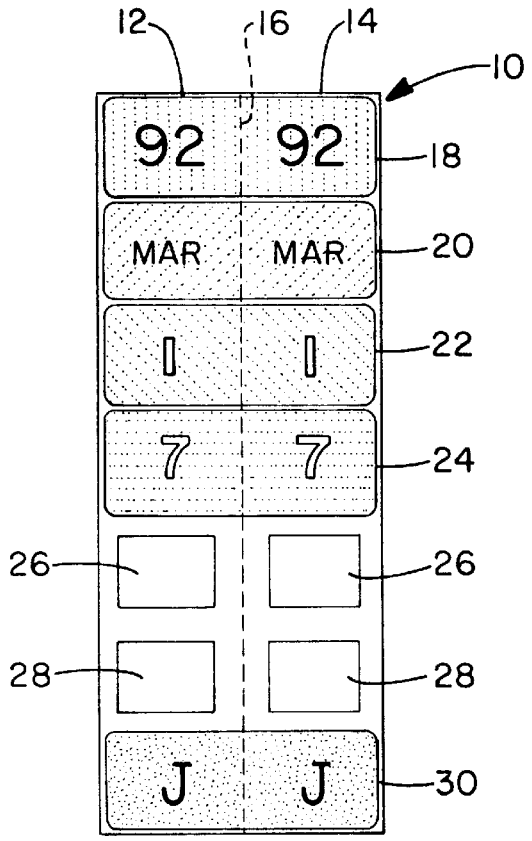
FIG. 1 is a top plan view of a first label according to the invention, such first label bearing indicia of birth date and the initial letter of the last name of the associated individual.

Referring now to the drawing and more particularly FIG. 1, it can be seen that a label according to the invention is designated generally by the numeral 10. The label 10 is preferably of paper or the like and is separated into identical first and second sides 12, 14 by a centerline 16 which may comprise perforations, a score line, or printed indicia.

On each of the sides 12, 14 of the label 10 are areas 18 which may include an indicia of the year that the associated file is opened. The numeral 92, shown in the area 18, indicates that the file was opened or is a file for the year 1992. As further shown, the area 18 may be color coded, with the associated color indicating the year designated within the area 18.

Also provided on either side 12, 14 of the centerline 16 are areas 20 for indicating the month of the birth date of the associated individual. In the situation shown, the month of March is indicated by the designation "MAR." Again, the background of the area 20 may be color coded, with a specific color being associated with each of the twelve months of the year.

Also presented on the label 10 and in association with the month designation area 20, are first and second date portions 22, 24 respectively. The first date portion 22 would typically receive one of the numerals 0, 1, 2 or 3, while the area 24 would receive any of the numerals 0–9. Accordingly, the areas 22–24 represent the specific date of the month designated by the month area 20. In the embodiment shown, the date March 17 is shown. Again, the areas 22, 24 may also be color coded, with each of the known numbers 0–9 having a uniquely associated color.

Also presented upon the label 10 are blank areas 26, 28 which are adapted to receive any hand written information which might be desired. Typically, the last two digits of the year of the birth date of the associated individual may be entered here. For example, if the individual were born on Mar. 17, 1951, the numeral 5 may be written into the area 26, and the numeral 1 into the area 28 to complete the birth date of the individual.

Finally, the designation area 30 is provided to receive the letter corresponding to the last initial of the individual with whom the label 10 is associated. As shown in FIG. 1, the areas 30 are provided with the letter J as would be associated with an individual named Jones, Johnson, Jeter, or the like.

It will be readily appreciated by those skilled in the art that any of the areas 18–30 of the label 10 depicted in FIG. 1 may be either preprinted or may be added by means of a label, self adhesive sticker, or the like. In its simplest form, the label 10 could comprise a piece of paper to which individual labels or stickers can be applied to the areas 18–30, as needed. Of course, in the preferred embodiment of the invention the label 30 is itself a pressure sensitive adhesive label folded over the edge of a file folder along the centerline 16 so that designation areas 18–30 are exposed on each side of the file.

Figure 2:
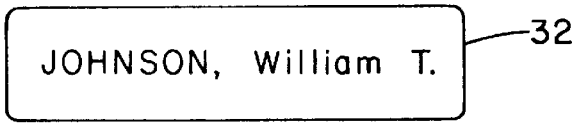
FIG. 2 is a top plan view of a second label according to the invention, such second label receiving a typed name of the associated individual thereon.

With reference now to FIG. 2, it can be seen that another portion of the label system of the invention comprises a label 32 which, in its simplest state, comprises pressure sensitive adhesive paper on which an individual's name can be printed. In the embodiment shown, the label 32 has been prepared for an individual named William T. Johnson.

Figure 3:
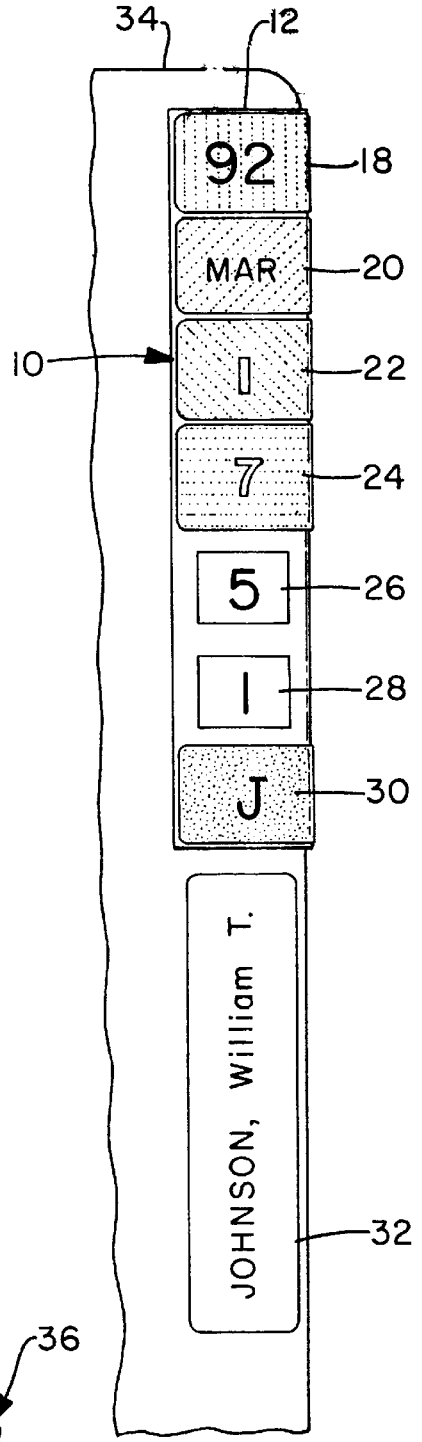
FIG. 3 is a partial sectional view of the file folder receiving the labels of FIGS. 1 and 2 thereon.

With reference now to FIG. 3, it can be seen that a file folder 34 receives a label 10 at a top end thereof, folded along the centerline 16 such that the side 12 of the label 10 is exposed on one side of the file folder, while the side 14 is exposed on the other. Also adhesively secured along an edge of the file folder 34 is the label 32, designating the name of the individual for whom the file 34 has been prepared.

In the embodiment of the filing system shown in FIGS. 1–3, a label 32 has been prepared for an individual named William T. Johnson. His name has been prepared, last name first, on the pressure sensitive adhesive label 32. A label 10 has also been prepared for Mr. Johnson, containing information primarily related to his birth date. In the area 18, the numeral 92 has been positioned, indicating that the file for Mr. Johnson was "opened" in 1992. Mr. Johnson's birth date of March 17th is designated by affixing appropriate labels at the areas 20, 22, 24, as discussed above. Since Mr. Johnson's birth date is Mar. 17, 1951, the year of his birth can be indicated on the label 10 by fining in the areas 26, 28 with the numerals 5 and 1, as indicated. Finally, a label bearing the letter "J" for Johnson is attached at the area 30 as shown.

Figure 4:
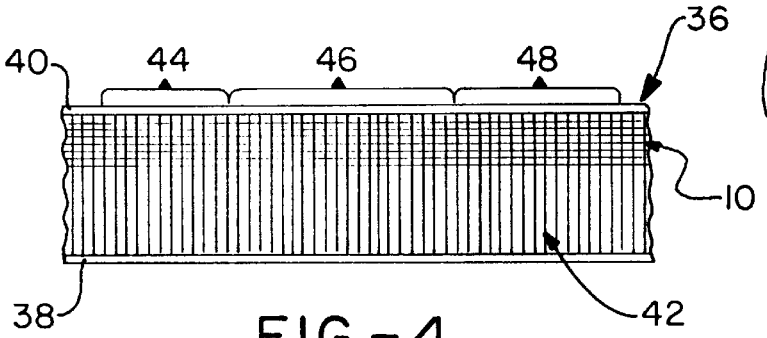
FIG. 4 is an illustrative view of a file area receiving files labeled according to FIG. 3 and positioned therein according to the method of the invention.

The label 10 is adhered over an edge of the file folder 34, while labels 32, preferably two in number, are adhered on either side of the file as well. Accordingly, file 34 has been prepared with an alpha numeric system, allowing the file 34 to first be grouped according to the date March 17, and then subsequently arranged alphabetically along with all other files bearing the March 17th date. The actual filing of the file 34 within the filing system is shown generally in FIG. 4 where a filing shelf is designated generally by the numeral 36. The filing shelf 36 would, of course, be a portion of a larger total filing system. The filing shelf 36 comprises a bottom shelf 38 and a top shelf 40, with an array of files 42 maintained therebetween. The files are arranged chronologically according to birth dates, with three consecutive birth dates shown designated by the numerals 44, 46, 48 in the filing shelf 36. For example, the section 44 may contain birth dates of March 16, the section 46 the birth dates of March 17, and the section 48 the birth dates of March 18. The file 34 would, of course, be received within the section 46. The exact location of the file 34 within the section 46 would be determined alphabetically, with the file 34 being in the "J" section and finding its specific location within the section 46 in standard alphabetic fashion.

It should be appreciated that the filing system of the invention is based upon main sets of files which are segregated chronologically by calendar dates, those dates corresponding to the birth dates of the individuals for whom the files are prepared. Since everyone has a birth date, and since nearly everyone remembers their birth date, the establishment of these main sets is easily attained. Similarly, subsets can be established within the main sets, such subsets being based upon the alphabet. Accordingly, within the filing system there are 366 main sets, and each main set is broken down into 26 subsets, one for each letter of the alphabet. In a preferred embodiment, their may be 27 subsets, with the designation "Mc" being treated as a letter itself. It is also anticipated as a portion of the invention that a main set be established and labeled as February 30th, a non existent date, to be given to those individuals who may not be able to recall their birth date. In such a system, there would be 367 main sets.

It has been found that an alpha numeric system such as that just described is capable of accommodating large numbers of files, one uniquely associated with a large number of individuals, without a significant risk of duplication of alpha numeric identifying criteria, and without a significant risk of misfiling or the like. The number of total main sets and subsets is, in the preferred embodiment, 367 times 27. It has further been found that nearly everyone knows their birth date, for it is a date that is reinforced every year when the birthday is celebrated. Of course, everyone has a name, and generally everyone knows their name. Accordingly, the information necessary for generating a file is readily at hand. By simply inquiring as to an individual's name and birth date, a file can be uniquely created for that individual which is unlikely to be misfiled, or confused with the file of another.

It will be readily appreciated by those skilled in the art that the labels 10, 32 may be of various natures and configurations. Various portions of the label 10 may be preprinted, and others may be generated and/or applied on site. A preferred color coding of the various label designations further prevents likelihood of misfiling, while the availability of areas such as the ares 26, 28 for hand written indicia further enhances the capabilities of the filing system.

The labels themselves may be of any suitable pressure sensitive adhesive laminate stock, and the stickers or labels to be received thereon may also be of various natures.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A method for filing files associated with individuals, comprising:

(a) affixing to each file at a first area a first sticker indicating a month and a second sticker indicating a day of the associated individual's birthday:

(b) affixing to each file at a second area a third sticker bearing a letter, said letter being the initial of the last name of said associated individual, wherein said first area with said first and second sticker indicating the individual's birthday precedes said second area with said individual's name on each file; and (c) placing the files in an array of files in a main set corresponding to said first and said second stickers and in a subset corresponding to said third sticker.

2. The method according to claim 1, further comprising the step of affixing a label bearing the associated individual's name to each file, said files being placed in said subsets alphabetically according to each said individual's name.

3. The method according to claim 2, further comprising the step of affixing to each file an indicia of the year the file was opened.

4. The method according to claim 2, further comprising the step of affixing to each file indicia of the year in which said associated individual was born.

* * * * *